United States Patent [19]

Murray

[11] 4,006,950

[45] Feb. 8, 1977

[54] DISH-STABILIZERS FOR DISH WASHING MACHINES

[76] Inventor: James M. Murray, 9129 S. Crescent Court, Oak Lawn, Ill. 60453

[22] Filed: Feb. 14, 1975

[21] Appl. No.: 550,004

[52] U.S. Cl. ..... 312/270; 134/135; 134/137; 248/500; 248/505; 312/271; 312/272; 312/273; 312/291; 312/352

[51] Int. Cl.[2] ..... B08B 11/00; A47L 15/00; A47L 15/50

[58] Field of Search ..... 61/37, 38; 102/22 BM; 134/131, 135, 199, 137; 312/23, 127, 229, 270, 271, 291, 296, 297, 309, 352; 211/181; 248/345, 500, 505; 160/108–111

[56] References Cited

UNITED STATES PATENTS

| | | | |
|---|---|---|---|
| 589,159 | 8/1897 | Burt | 312/270 X |
| 1,120,028 | 12/1914 | Cole | 312/270 |
| 2,163,865 | 6/1939 | Bitney | 211/181 X |
| 3,291,143 | 12/1966 | Huddle | 134/199 X |
| 3,616,806 | 11/1971 | Randall | 134/199 X |

OTHER PUBLICATIONS

"Engineering News-Record," Aug. 12, 1954, p. 25, Cols. 1 & 2.

*Primary Examiner*—Paul R. Gilliam
*Assistant Examiner*—Carl F. Pietruszka

[57] ABSTRACT

A mesh adapted to be lowered on a group of dishes contained in a work-basket of a dish washing machine. The mesh is limp and drapes from its weight over and around the dishes to maintain them as deposited and apart from each other. A mechanized application locates the mesh overhead in the dish washing machine, and causes it to be lowered automatically as stated on the insertion of the dish-loaded work-basket into the machine and raised back to the overhead position on the withdrawal of the work-basket.

3 Claims, 5 Drawing Figures

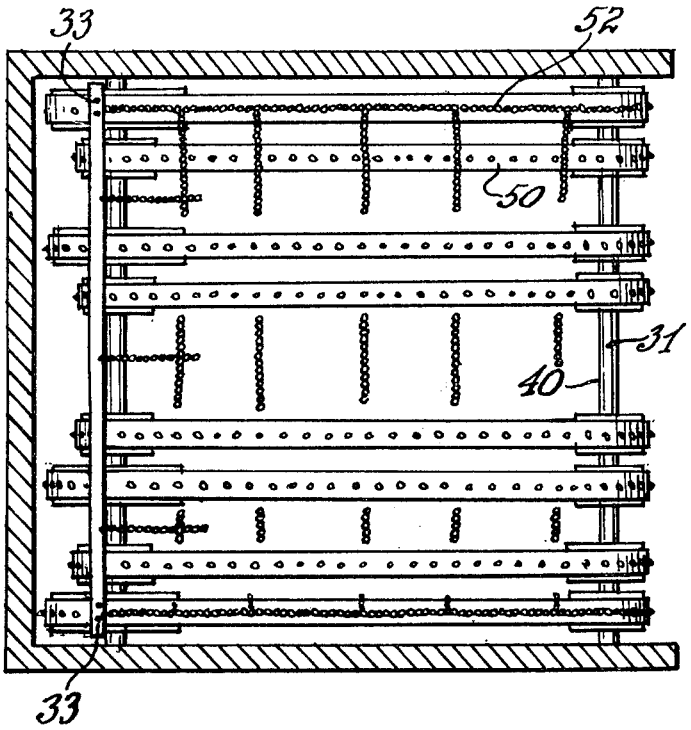
FIG. 4
FIG. 3
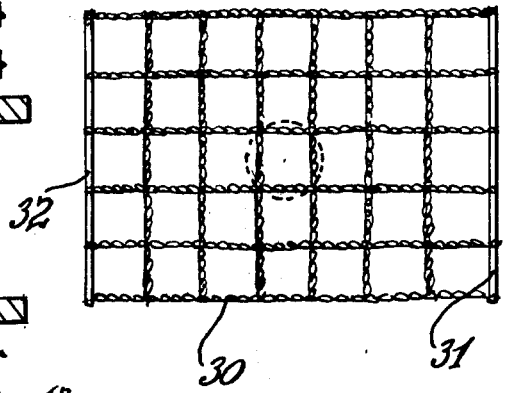
FIG. 5
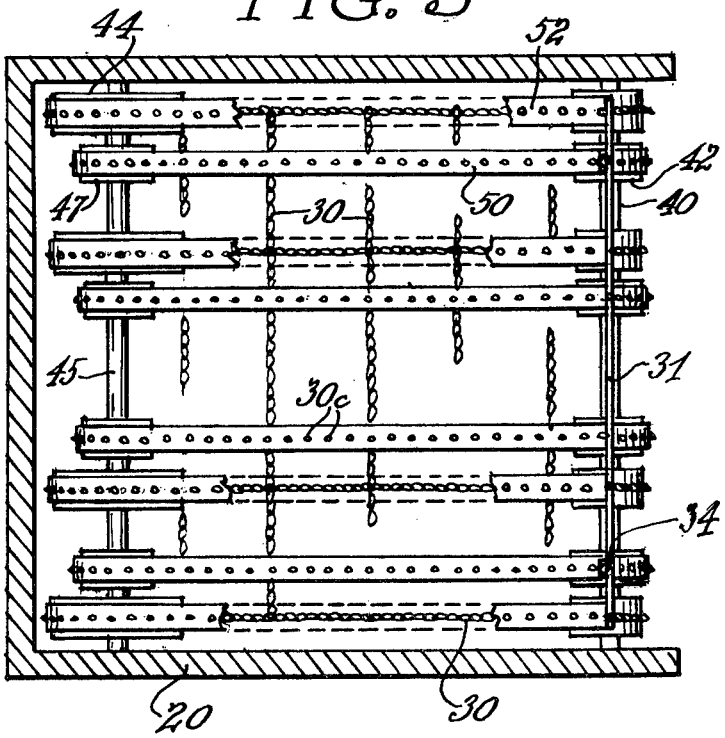

DISH-STABILIZERS FOR DISH WASHING MACHINES

This invention relates to automatic dish washing machines, and more particularly to the stabilizing of dishes deposited in the same. In machines of this kind cleaning solutions in jet form exert upward and lateral pressure on dishes deposited in the work-basket of the machine. Since residual food occurs mainly on the inside of dishes — such as cups, saucers, bowls, pitchers and the like — the usual practice is to deposit such dishes in the work-basket with their hollows facing downwardly for direct impact by the upward and lateral jets of cleaning fluid; and jets of higher pressure are used for items more difficult to clean. However, forceful jets tend to lift and turn some dishes with hollows up or facing away from the impact of the cleaning jets, leaving the insides of such dishes uncleaned or filled with wash water. Also, jets of higher pressure are objectionable because delicate china and thin glassware tend to scatter and break from the impact. Therefore, the practice has been to use jets of lesser force on all but heavy or sturdy items, such as pots and pans. Since this reduces the efficacy of the cleaning process, the remedy has been to use stronger cleaning solutions or allow longer time for cleaning. However, stronger cleaning solutions have a corrosive influence on dishes which have surface gilding or decorative coatings, making it inadvisable to include such items when strong cleaning solutions are used.

In view of the above situation, it is one object of the present invention to provide means which permit the use of high-pressure but relatively mild cleaning solutions, whereby to obtain thorough cleaning without injury to decorative surface coatings, and reduce cleaning time.

A further object is to provide a stabilizer for the dishes deposited in the work-basket which is effective to maintain the dishes in the original positions as placed, and check jets of forceful pressure from turning dishes over with hollows away from the impact of the cleaning jets, leaving dishes uncleaned.

Another object is to provide a stabilizer in the form of a limp mesh adapted to cover a group of dishes deposited in the work-basket of the dish washing machine, such mesh draping around each dish to check it against turning or damaging impact with other dishes.

A still further and important object is to provide a mechanism which keeps the aforesaid mesh overhead in space above the work-basket, but operates to lower the mesh into engagement with a group of dishes contained in the work-basket.

A final object is to design a mechanism which maintains the aforesaid mesh in overhead inactive position while the work-basket is extended from the machine and being loaded, but automatically lowers the mesh into effective position as the loaded work-basket is pushed into the machine.

A better understanding of the invention may be gained by reference to the accompanying drawings, in which FIG. 1 is a side view of the interior of a typical automatic dish washing machine containing upper and lower work-baskets, the upper work-basket located within the machine for a dish washing operation, and the lower work-basket extended for the removal or loading of dishes.

FIG. 3 is a plan view of the mesh on a small scale; and

Figure 1:
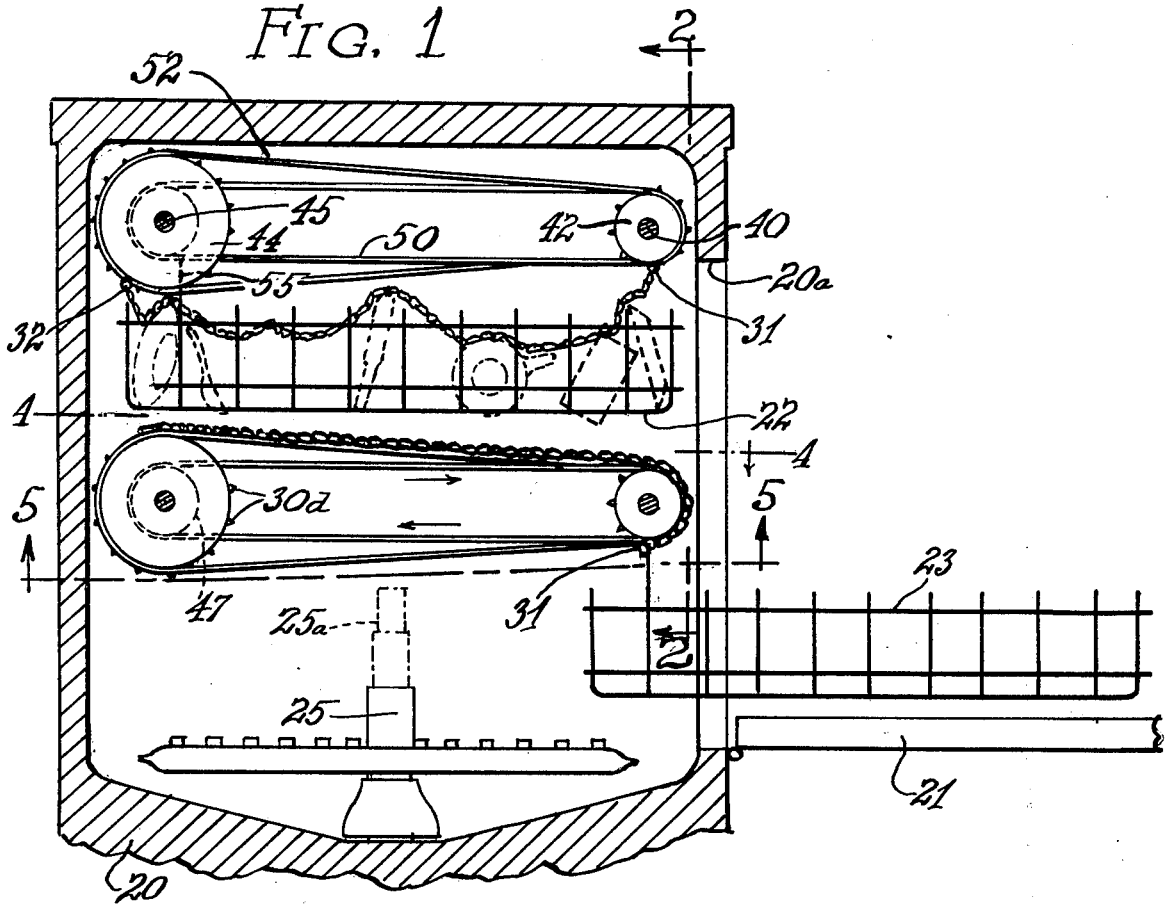
Figure 2:
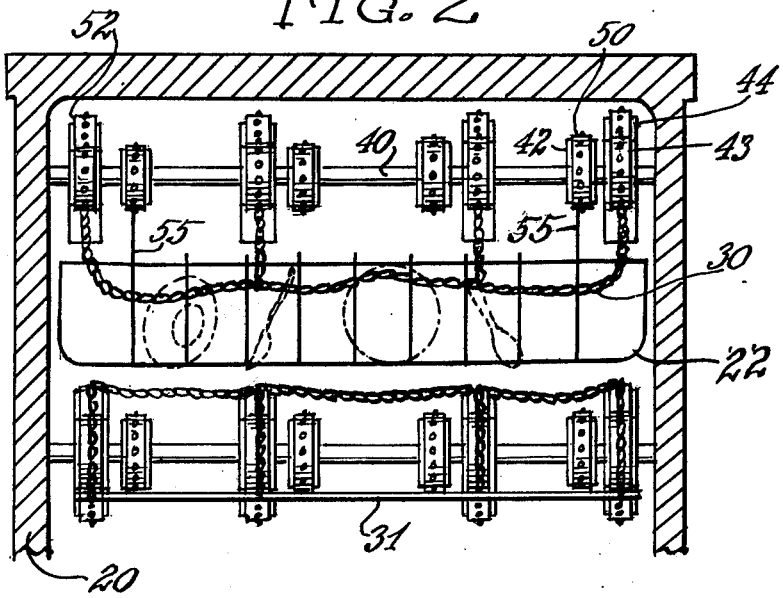
FIG. 2 is a frontal view on the section line 2—2 of FIG. 1.

FIGS. 4 and 5 are, respectively, sections on the lines 4—4 and 5—5 of FIG. 1.

Referring specifically to the drawings, 20 denotes the housing of a typical automatic dish washing machine. The door 21 of the machine opens downwardly to the horizontal position shown in FIG. 1 to reveal the frontal opening 20*a* of the housing. As mentioned before, the upper work-basket 22 is shown inside, while the lower one 23 is shown projected outwardly in a position just above the open door, as seen in FIG. 1. On the inside, typical revolving pressure units 25 and 25*a* for directing upward and spinning jets of cleaning fluid are shown, the nozzle of the unit 25 being plain as indicated by full lines in FIG. 1 or telescopically extensible as indicated by dotted lines in the same figure.

When a group of unclean dishes is deposited in the work-basket 22 — or 23 — with hollows down, the first application of the present invention before subjecting the dishes to a cleaning operation is to provide the basic dish-stabilizing device. FIG. 3 shows this feature as a mesh of crossed chains 30, which is actually of a size to cover the group of dishes in the work-basket; and the mesh is complete in area according to full lines in FIG. 3 when it is to be used in an upper work-basket 22, but formed with a central opening as indicated by dotted lines in the same figure when it is to be used in a lower work-basket 23 in order to clear the extended pressure unit 25. The chains of the mesh 30 are slack, and will cover and drape over a group of dishes to maintain them as deposited in the work-basket; and the chain links are jacketed with rubber or plastic material for soft engagement with the dishes. The mesh is reinforced at the ends by cross-bars 31 and 32.

While the above-described mesh may be designed as an accessory for manual deposit in work-baskets when the dish washing machine is used, the use and handling of the mesh as an accessory are eliminated in the present invention by installing the mesh as a part of the dish washing machine, with a mesh for each work-basket, and with means to automatically deposit or remove the mesh for each work-basket into or out of working relation with the dishes contained in the same.

The installation just mentioned occurs in the housing space immediately above those designed to be occupied by the work-baskets; and the upper and lower units of the installation are identical. For each unit the drawings show a pair of rotatable, horizontally spaced cross-shafts 40 and 45 journaled in the side walls of the housing 20. The frontal shaft 40 carries fixed pulleys 42 near the ends and free-running pulleys 43 next outside the pulleys 42. The rear shaft 45 carries fixed pulleys 47 in line with the frontal pulleys 42, and fixed pulleys 44 in line with the frontal pulleys 43. However, while the pulleys 42, 43 and 47 are of one size, the rear pulleys 44 are of larger diameter. A pair of endless belts 50 connects the inner, fixed pulleys 42 and 47, while a pair of longer belts 52 connect the free-running frontal pulleys 43 with the larger fixed pulleys 44, as seen in the upper portion of FIG. 4.

The central portion of FIG. 1 shows the mesh 30 in the overhead position relative to the lower belt drive, that is, when the dish washing machine is not in use, and the work-basket 23 is extended for the removal of or loading with dishes. This arrangement is viewed from above in FIG. 4 and underneath in FIG. 5; but only a portion of the mesh 30 is shown for purposes of clarity.

FIG. 4 shows that the rear reinforcing bar 32 of the mesh 30 is secured by rivets 33 to the belts 52 over the large pulleys 44; and FIG. 5 shows that the frontal bar 31 is secured by rivets 34 to the belts 50 over the fixed pulleys 42. FIG. 1 — lower center — and FIG. 5 show that struts 55 rise from the rear of the work-basket to connect by welding to the cross-bar 31.

Referring to the center of FIG. 1, the lower work-basket may be pushed — when loaded with dishes — into the machine 20 for a dish washing operation. This movement causes the struts 55 to draw on the mesh 30 after it rounds the frontal pulleys, and move it rearwardly under the lower runs of the belts. However, the larger pulleys 44 will overdrive the mesh during this underslung movement, so that it will sink progressively from its weight into the work-basket and drape over and between the dishes as seen in the upper part of FIG. 1. It follows that the reverse action of the belt mechanism will restore the mesh to the overhead, idle position when the work-basket is drawn out of the dish washing machine on the completion of the cleaning operation.

The belt drives are made positive by making the belts with holes 30*c* to receive teeth 30*d* from the pulleys of the drives. Also, these are duplicated at intermediate points across the interior of the dish washing machine housing as shown in FIGS. 4 and 5, providing added bearings for the mesh bars.

It will now be apparent that the basic feature of the invention — the draping mesh — is self-engaging and conforming to the various dishes in the work-basket, and becomes a resistance to stabilize them against the upward and lateral thrust of the cleaning solution jets. Therefore, these may be made forceful for the more thorough cleaning of the dishes, with the assurance that the soiled internal parts of the dishes will remain underneath during the cleaning process and in the direct path of the jets. Further, with the dishes stable, they will not slide with impact against other dishes and cause chipping, cracking or breaking of the same. Further, with the benefit of stronger jet pressures, milder cleaning solutions may be used, these reducing the risk of corroding surface gilding or decorative coatings on some dishes. Further, the mesh-moving installation relieves the user of any concern about providing, handling and storing of the protective mesh, so that the dish-controlling facility becomes automatic once a loaded work-basket is inserted into the housing. Further, the novel installation is entirely clear of any part of the dish-cleaning mechanism, and does not require electrical power or controls. In other words, the installation is a simple adjunct for the more efficient, more economical and safer treatment of dishes during the dish washing operation of the machine.

I claim:

1. A stabilizer for dishes contained in a workbasket of a dishwashing machine to maintain them therein as deposited and apart from each other comprising a limp mesh having a length greater than that of the work basket and adapted to be lowered into the work basket when same is inserted into said machine and to be lifted from and supported above said work basket when same is removed from said machine and conveyor means to support and to move the mesh into and out of said work basket, said conveyor means comprising a pair of co-operating differentially-driven conveyors and drive means between the work basket and one of said conveyors to advance one end of the mesh at the speed of the work basket movement and the opposite end of the mesh at a faster speed to impose a gradual draping of the mesh into said work basket upon its insertion and to quickly lift said mesh from said work basket upon its withdrawal.

2. The structure of claim 1, said first conveyor comprising a pair of horizontally spaced parallel shafts mounted above said work basket perpendicular to the direction of movement thereof, at least one endless-belt conveyor connecting the shafts, a connection from the work basket to guide the first conveyor according to the movements of the work basket, said one end of the mesh being connected to the first conveyor, said second conveyor comprising at least one endless-belt conveyor between the shafts on at least one end of each and adapted to be driven by the first conveyor at said faster speed, said opposite end of the mesh being connected to the second conveyor.

3. The structure of claim 2, said first conveyor further comprising at least a pair of fixed even sized pulleys carried by the shafts and connected by said at least one endless belt, said connection from the work basket operatively contacting said belt, said second conveyor having a a relatively larger pulley fixed on one of said shafts and a freely rotating pulley mounted on said opposite shaft and an endless belt from the larger pulley to said freely rotating pulley, said relatively larger pulley driving said freely rotating pulley at a faster rate than said fixed pulley.

* * * * *